US007952455B2

(12) United States Patent
Crawshaw

(10) Patent No.: US 7,952,455 B2
(45) Date of Patent: May 31, 2011

(54) MAGNETIC DEVICE

(75) Inventor: Allan D. Crawshaw, Shelby Township, MI (US)

(73) Assignee: Allan D. Crawshaw, Shelby Township, MI (US)

( * ) Notice: Subject to any disclaimer, the term of this patent is extended or adjusted under 35 U.S.C. 154(b) by 234 days.

(21) Appl. No.: 12/405,289

(22) Filed: Mar. 17, 2009

(65) Prior Publication Data

US 2010/0237969 A1 Sep. 23, 2010

(51) Int. Cl.

| | |
|---|---|
| ***H01F 7/00*** | (2006.01) |
| ***H01F 1/00*** | (2006.01) |
| ***H01F 7/20*** | (2006.01) |
| ***H01F 13/00*** | (2006.01) |
| ***H01F 7/02*** | (2006.01) |
| ***B65H 3/16*** | (2006.01) |

(52) U.S. Cl. ..... 335/219; 335/209; 335/284; 335/285; 335/288; 335/296; 335/302; 335/306; 271/18.1

(58) Field of Classification Search ..... 335/209, 335/219, 284, 285–299, 302–306; 271/18.1, 271/90, 105, 901; 198/422, 431; 414/788.9, 414/790.7, 793.3, 901

See application file for complete search history.

(56) References Cited

U.S. PATENT DOCUMENTS

| | | | | | |
|---|---|---|---|---|---|
| 3,120,890 | A * | 2/1964 | Waltz | 198/381 |
| 3,477,050 | A * | 11/1969 | Hinger | 335/285 |
| 4,034,846 | A * | 7/1977 | Burgis et al. | 414/788.9 |
| 4,481,437 | A * | 11/1984 | Parker | 310/191 |
| 4,743,006 | A * | 5/1988 | Bolle et al. | 271/18.1 |
| 5,018,939 | A * | 5/1991 | Kishi et al. | 414/795.4 |
| 5,669,156 | A * | 9/1997 | Vejchoda | 34/248 |
| 6,146,086 | A * | 11/2000 | Snell et al. | 414/797.9 |
| 6,293,538 | B1 * | 9/2001 | Niedzielski et al. | 271/18.1 |
| 6,481,706 | B1 * | 11/2002 | Gaeddert et al. | 271/18.1 |
| 7,015,782 | B2 * | 3/2006 | Kincaid et al. | 335/306 |
| 7,696,457 | B2 * | 4/2010 | Baxter et al. | 219/653 |
| 2009/0256451 | A1 * | 10/2009 | Braune et al. | 310/75 R |

OTHER PUBLICATIONS

Puritan Magnetics, Inc., Magnetic Protection for Products & Equipment, Catalog No. 2000, 4 pp.

Puritan Magnetic, Inc., Material Handling Magnets, Catalog No. 6000, 4 pp.

* cited by examiner

*Primary Examiner* — Anh T Mai

*Assistant Examiner* — Mohamad A Musleh

(74) *Attorney, Agent, or Firm* — Gifford, Krass, Sprinkle, Anderson & Citkowski, P.C.

(57) ABSTRACT

A magnetic device having a housing with a front wall. A first magnet assembly includes a north and south pole and a second magnet assembly also includes a north and south pole. The magnet assemblies are pivotally mounted in the housing and pivotal between a first position in which the north pole of the first magnet assembly and the south pole of the second magnet assembly face each other and are positioned adjacent the front wall of the housing, and a second position in which the north pole of the first magnet assembly and the south pole of the second magnet assembly face each other and are retracted from the front wall. An actuator pivots the magnet assemblies between their first and second positions while a spring urges the magnet assemblies toward the second position.

9 Claims, 2 Drawing Sheets

MAGNETIC DEVICE

BACKGROUND OF THE INVENTION

I. Field of the Invention

The present invention relates to magnetic devices.

II. Description of Related Art

Magnetic devices are used in numerous industrial applications. For example, one use of a magnetic device is known as a magnetic fanner.

In a magnetic fanner, magnets are contained within the housing having a non-metallic front wall. Typically, a pair of magnet assemblies, each having a north and south pole, are contained within the housing so that the north pole of the first magnet assembly faces the housing front wall while the south pole of the second magnet assembly faces the housing front. The magnets are spaced apart from each other.

Consequently, when a stacked pile of ferrous material is positioned next to the front wall of the housing, the magnet assemblies induce magnetic flux in the sheets of the ferrous material which causes the ferrous material to repel from each other and fan apart. This, in turn, facilitates the manipulation of single sheets of the ferrous material, especially by a robot.

In order to switch the magnetic flux in these previously known devices, an actuator was typically employed to move the magnet assemblies between a forward position, in which one pole of both magnet assemblies were positioned closely adjacent the front wall of the housing, and a retracted position in which the poles of the magnets in the magnet assembly are retracted from the front wall of the housing. In a retracted position, the magnetic flux induced through the housing front wall is reduced.

These previously known magnetic devices, however, have not proven wholly satisfactory in operation. First, even when the magnet assemblies are in their retracted position, a significant amount of flux still passes through the housing front wall. As such, the magnet assemblies still magnetically couple with ferrous materials outside the housing, even when such coupling is not desired.

A still further disadvantage of these previously known magnetic devices is that such devices lack a failsafe operation. As such, such magnetic devices may unexpectedly and undesirably shift to their operative position in which the magnets in the magnetic assemblies move to their operative position in which the magnets are positioned closely adjacent the housing front wall. This, in turn, can cause injury to personnel handling ferrous materials near the magnetic device.

SUMMARY OF THE PRESENT INVENTION

The present invention provides a magnetic device, such as a magnetic fanner, which overcomes all of the above-mentioned disadvantages of the previously known devices.

The magnetic device of the present invention comprises a housing having a front wall. At least one, but preferably a first magnet assembly as well as a second magnetic assembly each have a north and a south pole are contained within the housing. Preferably, each magnet assembly is formed from a plurality of stacked permanent magnets.

The first and second magnet assemblies are pivotally mounted to the housing and pivotal between a first position in which the north pole of the first magnet assembly and the south pole of the second magnet assembly are positioned closely adjacent and face the front wall of the housing. In the first position, the magnetic device is in its operative state such that a magnetic flux is generated through the front wall of the housing.

Conversely, in their second position, the first and second magnet assemblies are retracted away from the front wall of the housing and also pivoted so that the north pole of the first magnet assembly faces and is positioned closely adjacent the south pole of the second magnet assembly. In this position, little magnetic flux passes through the housing front wall.

An actuator pivots the magnet assemblies between their first and second position. Preferably, the actuator comprises a pneumatic actuator which pivots the magnet assemblies through a rack and pinion mechanism although other types of actuators and pivot assemblies may also be used. In addition, a compression spring urges the magnetic assemblies to their second position once pneumatic pressure is released from the pneumatic actuator. Consequently, in the event of failure of the pneumatic actuator, the first and second magnet assemblies are automatically pivoted to their second and inoperable position.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
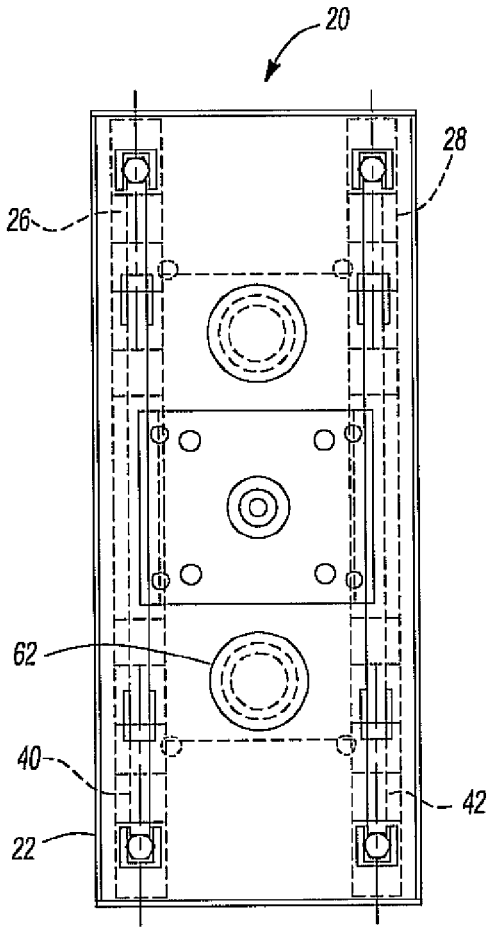
FIG. 1 is a front view of a preferred embodiment of the invention.
Figure 2:
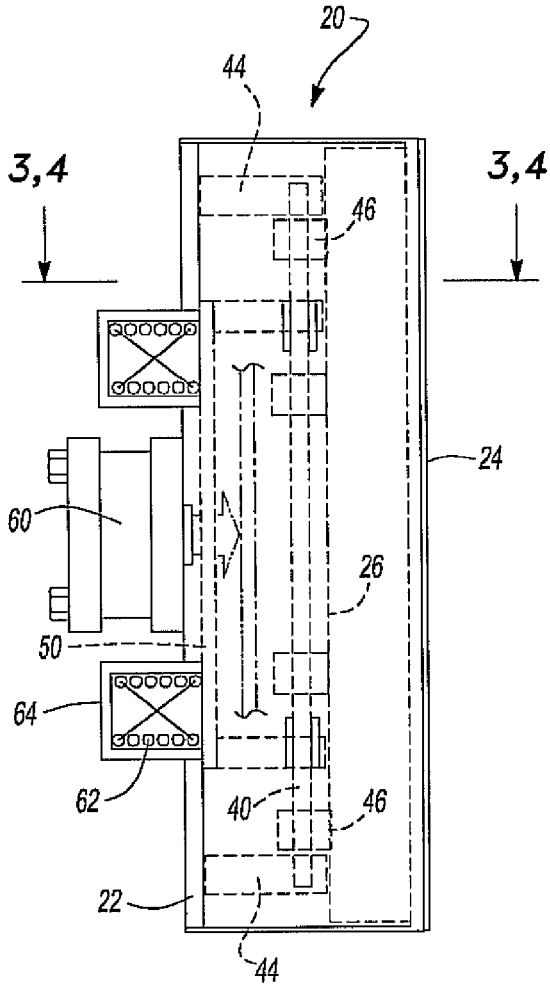
FIG. 2 is a side view thereof.

With reference first to FIGS. 1 and 2, a magnetic device 20 according to the present invention is illustrated. The magnetic device 20 includes a housing 22 having a front wall 24. At least the front wall 24, and preferably the entire housing 22, is constructed of a nonmagnetic material, such as stainless steel, aluminum or the like.

Figure 3:
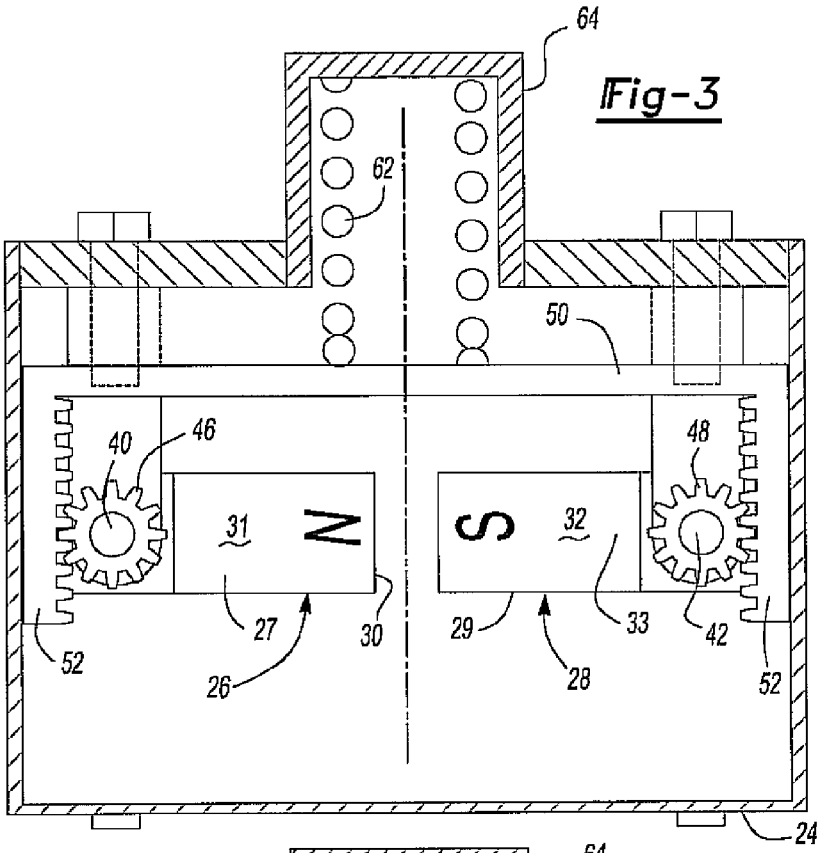
FIG. 3 is a view taken along line 3-3 in FIG. 2 and illustrating the magnets in a retracted position.

A first magnet assembly 26 and a second magnet assembly 28 are contained within the housing 22. As shown in FIGS. 1 and 3, the first magnet assembly 26 preferably includes a plurality of stacked, permanent magnets 27, each having a north pole at one end 30 and a south pole at its opposite end 31. The permanent magnets 27 in the magnetic assembly 26 are arranged so that all of the north poles of the permanent magnets are aligned with each other.

Similarly, the second magnet assembly 28, like the first magnet assembly 26, comprises a plurality of permanent magnets 29 stacked one on top of each other. One end 32 of each permanent magnet 29 in the second magnet assembly 28 is a south pole while the opposite end 33 of the permanent magnets 29 in the magnet assembly 28 are a north pole.

Even though the magnets in the magnet assemblies 26 and 28 are preferably permanent magnets, it will be understood, of course, that other types of magnets, such as electromagnets, may alternatively be used.

The magnet assemblies 26 and 28 are movably mounted in the housing between a first position in which one pole of each magnet assembly is closely adjacent the housing front wall 24 and a second position in which the magnet poles are retracted from the front wall 24. However, in the preferred embodiment, the magnet assemblies 26 and 28 are pivotally mounted within the interior of the housing 22 between the first position, illustrated in FIG. 4, and the second position, illustrated in FIG. 3. In their first position, the north pole of the first magnet assembly 26 faces and is positioned adjacent the front wall 24 of the housing 22. Likewise, in their first position the south pole of the second magnet assembly 28 also faces the housing front wall 24 and is spaced apart from the first magnet assembly 26. In this position, the magnet assemblies 26 and 28 are spaced apart from each other and generate magnetic flux through the housing front wall 24.

Conversely, in their second position (FIG. 3), the north pole of the first magnet assembly 26 and south pole of the second magnet assembly 28 are retracted away from the front wall 24 of the housing 22, face and are closely adjacent to each other. In this position, the flux between the first and second magnet assemblies 26 and 28 is contained primarily within the housing 22 in the area between the magnet assemblies 26 and 28.

Any conventional mechanism may be utilized to pivot the magnet assemblies 26 and 28 between their first position (FIG. 4) and their second position (FIG. 3). However, as best shown in FIGS. 1-3, in the preferred embodiment of the invention, a pair of elongated pivot rods 40 and 42 are pivotally mounted by pivot blocks 44 (FIG. 2) so that the pivot rods 40 and 42 extend generally parallel to but spaced apart from the front wall 24 of the housing 22. The first magnet assembly 26 is secured to the first rod 40 adjacent its south pole end 31 while, similarly, the second magnet assembly 28 is attached to the second pivot rod 42 adjacent its north pole end 33.

At least one pinion 46 is secured to the first pivot rod 40 so that the first pinion 46, rod 40 and magnet assembly 26 all pivot in unison with each other. Similarly, a second pinion 48 is secured to the second pivot rod 42 so that the second pinion 48, pivot rod 42 and second magnet assembly 28 all pivot in unison with each other.

A plate 50 is slidably mounted within the interior of the housing 22 in a direction perpendicular to the front wall 24. At least one and preferably a plurality of racks 52 are secured to the plate 50 so that one rack is associated with each pinion 46 and 48 on the pivot rods 40 and 42. Consequently, extension of the plate 50 towards the front wall 24 of the housing 22 simultaneously extends the racks 52 and pivots the magnet assemblies 26 and 28 to their second retracted or inoperable position (FIG. 3). Conversely, retraction of the plate 50 to the position shown in FIG. 4 simultaneously retracts the racks 52 and pivots the first and second magnet assemblies 26 and 28 to their first or operable position (FIG. 1) in which the ends 30 and 32 of the magnet assemblies 26 and 28, respectively, are spaced apart from each other and also face and are closely adjacent the front wall 24.

Figure 4:
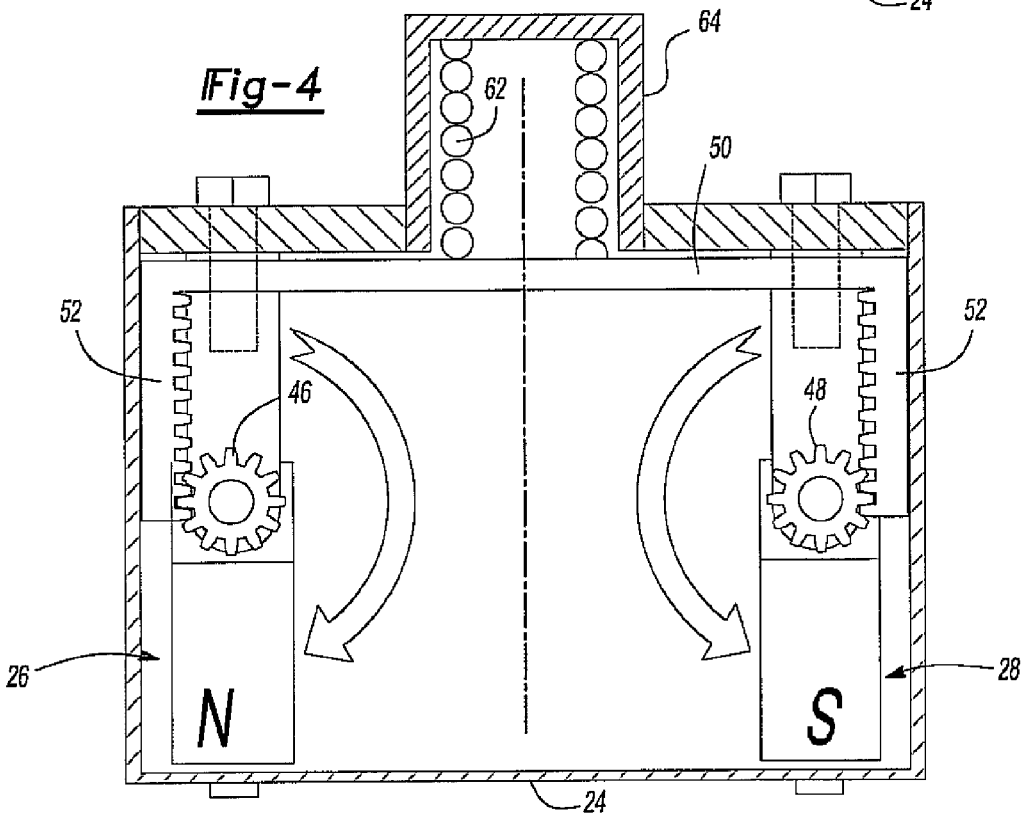
FIG. 4 is a view taken along line 4-4 in FIG. 2 and illustrating the magnets in an extended operative position.

Any conventional actuator may be used to shift the plate 50 with its attached racks 52 within the housing 22. However, in the preferred embodiment, a pneumatic actuator 60 (FIG. 2) is operatively connected to the plate 50. Upon pressurization, the pneumatic actuator 60 pulls the plate 50 rearwardly away from the front wall 24 thus pivoting the magnet assemblies 26 and 28 to their first or operable position (FIG. 4).

At least one, and preferably a pair of spaced apart compression springs 62 are maintained in a state of compression between a spring retainer 64 attached to the housing 22 and the plate 50. Upon depressurization of the pneumatic cylinder 60, either intentionally or through failure of the pneumatic cylinder 60, the springs 62 decompress thus forcing the plate 50 toward the housing front wall and simultaneously pivoting the magnet assemblies 26 and 28 to their second or inoperable position (FIG. 3). In this fashion, the springs 62 act as a failsafe mechanism to ensure that the magnet assemblies 26 and 28 are moved or pivoted to their second or inoperative position in the event of failure of the pneumatic actuator 60.

The magnetic device of the present invention has numerous uses. For example, the magnetic device of the present invention may be used as a fanner for sheets of ferrous material. There are, of course, other uses for the magnetic device of the present invention, such as lift magnets, conveyors, floor and road sweepers, and the like.

Unlike the previously known devices, the magnetic device of the present invention, by pivoting the magnets toward each other so that their north and south poles register when the magnetic device is in its inoperative position, minimizes the amount of magnetic flux created exteriorly of the housing. Additionally, the failsafe mechanism provided by the compression springs 62 ensures that the magnetic device will always be switched to its off or inoperable position in the event of failure of the actuator.

Although the magnetic device has been described as having a pair of magnet assemblies, it will be understood, of course, that a single magnet assembly having one or more magnets may alternatively be used. If a single magnet assembly is used, the actuator, when powered, drives the single magnet assembly to the first position in which one magnetic pole is adjacent the housing front wall 24 while the spring 62 urges the magnet assembly towards the second position in which the pole of the magnet assembly is retracted from the front wall 24. Thus, upon failure of the actuator, the spring 62 automatically moves the single magnet assembly to the second or retracted position.

From the foregoing, it can be seen that the present invention provides a simple and yet highly effective magnetic device having numerous applications. Having described my invention, however, many modifications thereto will become apparent to those skilled in the art to which it pertains without deviation from the spirit of the invention as defined by the scope of the appended claims.

I claim:

1. A magnetic device comprising:

a housing having a front wall, a first magnet assembly having a north pole and a south pole, said first magnet assembly being mounted to said housing and pivotal about a first axis between a first position in which one pole of said first magnet assembly is positioned adjacent said front wall of said housing, and a second position in which said one pole of said first magnet assembly is retracted from said front wall of said housing, a second magnet assembly having a north pole and a south pole, said second magnet assembly being mounted to said housing and pivotal about a second axis spaced from and parallel to said first axis between a first position in which one pole of said second magnet assembly faces and is positioned adjacent said front wall of said housing, and a second position in which said one pole of said second magnet assembly is retracted from said front wall of said housing, an actuator which, when powered, pivots said first and second magnet assemblies from their respective said second positions to their respective said first positions, and a spring which urges said first and second magnet assemblies toward their respective said second positions so that, upon failure of said actuator, said spring urges said first and second magnet assemblies to their respective said second position positions.

2. The invention as defined in claim 1 wherein opposite poles of said first and second magnet assemblies face each other in said second position.

3. The invention as defined in claim 1 wherein each magnet assembly comprises a plurality of stacked magnets.

4. The invention as defined in claim 3 wherein said stacked magnets are permanent magnets.

5. The invention as defined in claim 1 wherein said first magnet assembly is mounted on a rod pivotally mounted to said housing, a pinion attached to said rod and a rack slidably mounted to said housing and in mesh with said pinion, wherein said actuator is connected to said rack to linearly move said rack.

6. The invention as defined in claim 5 wherein said actuation comprises a pneumatic actuator.

7. The invention as defined in claim 1 wherein said housing front wall is constructed of a non-magnetic material.

8. The invention as defined in claim 7 wherein said non-magnetic material comprises stainless steel.

9. The invention as defined in claim 1 wherein said magnetic device is a fanner.

* * * * *